US007429934B2

(12) United States Patent
Sim et al.

(10) Patent No.: US 7,429,934 B2
(45) Date of Patent: Sep. 30, 2008

(54) MUD PULSE LANDING ASSEMBLY FOR USE IN DIRECTIONAL DRILLING

(75) Inventors: David F. Sim, Alberta (CA); Michael T. Sutherland, Alberta (CA)

(73) Assignee: Ryan Energy Technologies, Calgary, AB (CA)

( * ) Notice: Subject to any disclaimer, the term of this patent is extended or adjusted under 35 U.S.C. 154(b) by 285 days.

(21) Appl. No.: 10/531,562

(22) PCT Filed: Oct. 17, 2003

(86) PCT No.: PCT/CA03/01593

§ 371 (c)(1),
(2), (4) Date: Oct. 3, 2005

(87) PCT Pub. No.: WO2004/035989

PCT Pub. Date: Apr. 29, 2004

(65) Prior Publication Data

US 2006/0098532 A1 May 11, 2006

(30) Foreign Application Priority Data

Oct. 18, 2002 (CA) ..... 2408868

(51) Int. Cl.
*H04Q 9/00* (2006.01)

(52) U.S. Cl. ..... 340/870.07; 340/854.3; 340/855.7; 367/82; 367/85; 175/62

(58) Field of Classification Search ..... 340/870.07, 340/870.01, 853.1, 854.3, 854.4, 855.3, 855.7; 367/82–85; 251/62; 175/65
See application file for complete search history.

(56) References Cited

U.S. PATENT DOCUMENTS

| | | | |
|---|---|---|---|
| 4,120,097 | A | 10/1978 | Jeter |
| 4,699,352 | A | 10/1987 | Mumby |
| 5,473,579 | A | 12/1995 | Jeter |

FOREIGN PATENT DOCUMENTS

| | | | |
|---|---|---|---|
| DE | 19627719 | A1 | 1/1998 |
| DE | 10059860 | C1 | 6/2002 |

*Primary Examiner*—Jeff Hofsass
*Assistant Examiner*—Sisay Yacob
(74) *Attorney, Agent, or Firm*—Barnes & Thornburg LLP

(57) ABSTRACT

A mud pulse landing assembly (10) which allows for the removal of the mud pulse generator (16) containing the mud pulse orifice (106), thus creating an unobstructed passageway for any tool or instrumentation that may need to be passed through the drill string. The retainer (14) of the mud pulse landing assembly also provides a universal mount for engaging alternate tools or instrumentation for use in analyzing the borehole geology. The retainer (14) is positioned between the mud pulse generator (16) and the landing sub body, so as to protect the retainer from the turbulent and abrasive mud flow, and to prevent obstruction of the area downstream of the compact muleshoe (60).

5 Claims, 12 Drawing Sheets

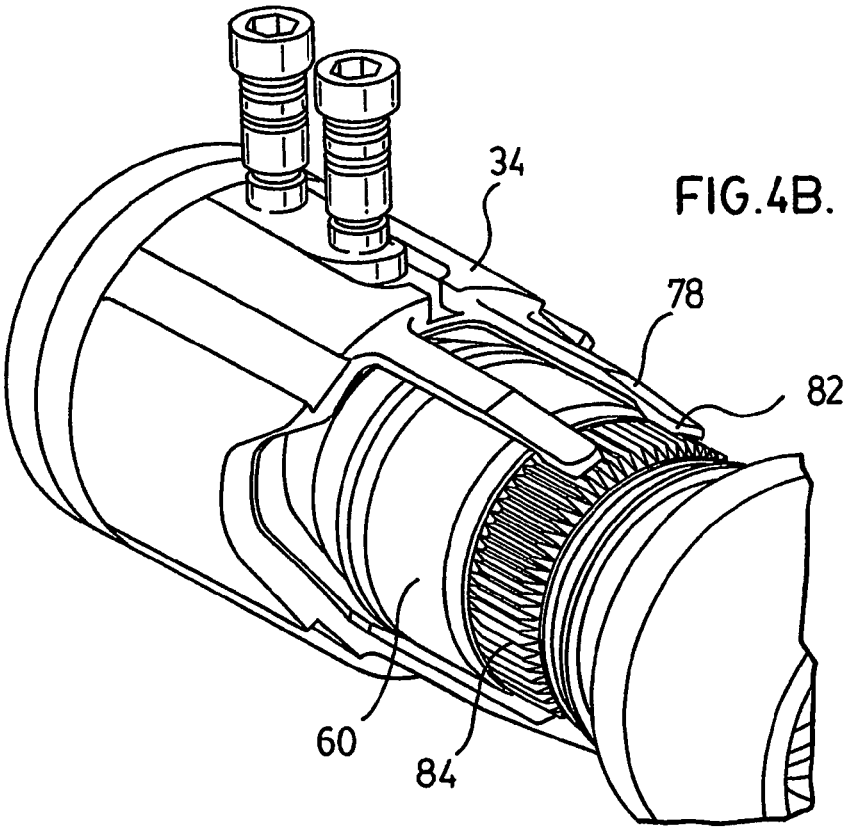
FIG.4B.
FIG.4C.
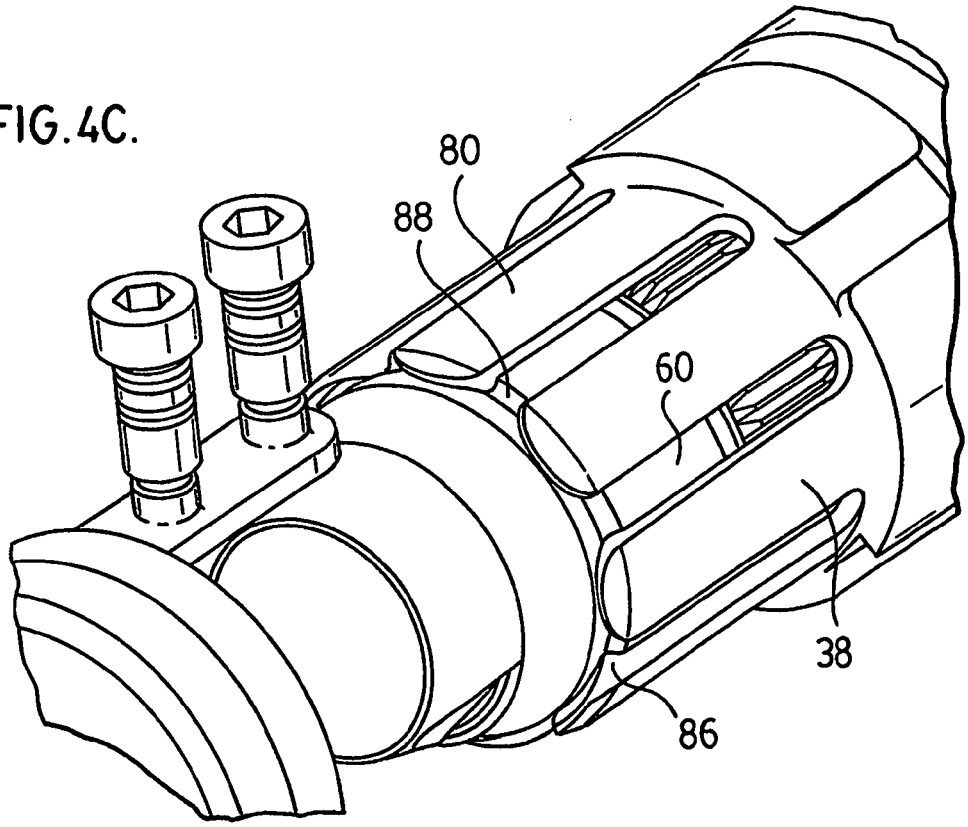

MUD PULSE LANDING ASSEMBLY FOR USE IN DIRECTIONAL DRILLING

FIELD OF THE INVENTION

This invention relates to a mud pulse landing assembly having a removable mud pulse generator for use in drill strings, particularly directional oil well drilling systems.

BACKGROUND OF THE INVENTION

Communicating with the instrumented end of a drill string inside a well bore deep within the Earth presents unique challenges. The development of real time communications for use in well bores has revolutionized the drilling industry; this is especially evident in measurement-while-drilling (MWD) technologies. Various wireless communication methods have been developed for MWD operations including mud pulse telemetry as well as electromagnetic-based systems. In traditional mud pulse systems, an orifice works in concert with a reciprocating piston to vary the drilling mud pressure near the bottom end of the drill string, thereby forming pulses that transmit through the mud to the surface. Using this system, digitally encoded messages can be sent via mud pulses, said pulses being received and interpreted by telemetry devices located at the surface. In some designs, the orifice represents the bore terminus of the tool string since previous designs have the orifice permanently fixed in position. As a result, it has been previously impossible to pass tools beyond this point, without first removing the entire drill string, a costly and time consuming task. Another design is presented in U.S. Pat. No. 4,636,995 where a flow constrictor and throttling member is provided as an integrated retrievable unit. The unit, however, cannot be displaced and moved downwards past its terminal seat or stop. In addition, the unit positions the pulser unit at the top of the assembly, subjecting the mechanics of the mud pulser to the extreme flow turbulence that is experienced during drilling operations. Additionally, this prior art design does not incorporate a retainer.

There is therefore a significant need for an alternate mud pulse telemetry system that does not obstruct passage of sensing devices through the drill string. A means to remove the obstruction, and an object of the present invention, is to have a mud pulse orifice incorporated into the removable mud pulse generator. This eliminates the obstruction and the limitation of previous mud pulse telemetry systems. A further object is to provide a retainer system in a mud pulse landing assembly that engages the removable mud pulse generator to prevent spatial and rotational movement. Another object is to provide a modular mud pulse generator system that allows for replacement of only those parts that have failed. A removable system must have the ability to self align, should be self-seating and be removable in either the upward or downward direction from the normal operating position.

SUMMARY OF THE INVENTION

The mud pulse landing assembly, in accordance with an aspect of this invention, allows for the removal of the mud pulse generator containing the mud pulse orifice, thus creating an unobstructed passageway for any device that may need to be passed through the drill string. The retainer of the mud pulse landing assembly also provides a universal mount for engaging alternate tools or instrumentation for use in analyzing the borehole geology.

The mud pulse landing assembly comprises a mud pulse landing sub having a longitudinal bore, contained with the longitudinal bore is positioned a stationary retainer to which a removable mud pulse generator can be releasably connected. The mud pulse orifice and MDW tool containing the piston actuator are housed within the removable mud pulse generator. The removable mud pulse generator can be remotely detached from the stationary latching subassembly by either applying downward pressure to drive the removable mud pulse generator further down the drill string, or it may be detached by applying an upward force to pull the removable mud pulse generator up the drill string. Provided is a means for releasably connecting the removable mud pulse generator to the stationary latch subassembly, where the removable mud pulse generator is self seating and self aligning.

According to an aspect of the present invention, provided is a mud pulse assembly for producing mud pulses for communicating during directional drilling data telemetry, the improvement comprises:

a removable mud pulse generator for positioning in a landing sub body, said removable mud pulse generator having a outlet end, and a retainer for releasably engaging said removable mud pulse generator in said landing sub body, said retainer engaging said mud pulse generator at or upstream of said outlet end, said retainer being remotely operable to release said removable mud pulse generator from said mud pulse assembly.

BRIEF DESCRIPTION OF THE DRAWINGS

FIG. 4B is a perspective view of the embodiment shown in FIG. 1, showing engagement of the splines with the compact muleshoe.

FIG. 4C is a perspective view of the embodiment shown in FIG. 1, showing engagement of the detent or ridge with the compact muleshoe.

DETAILED DESCRIPTION OF THE PREFERRED EMBODIMENTS

Figure 1:
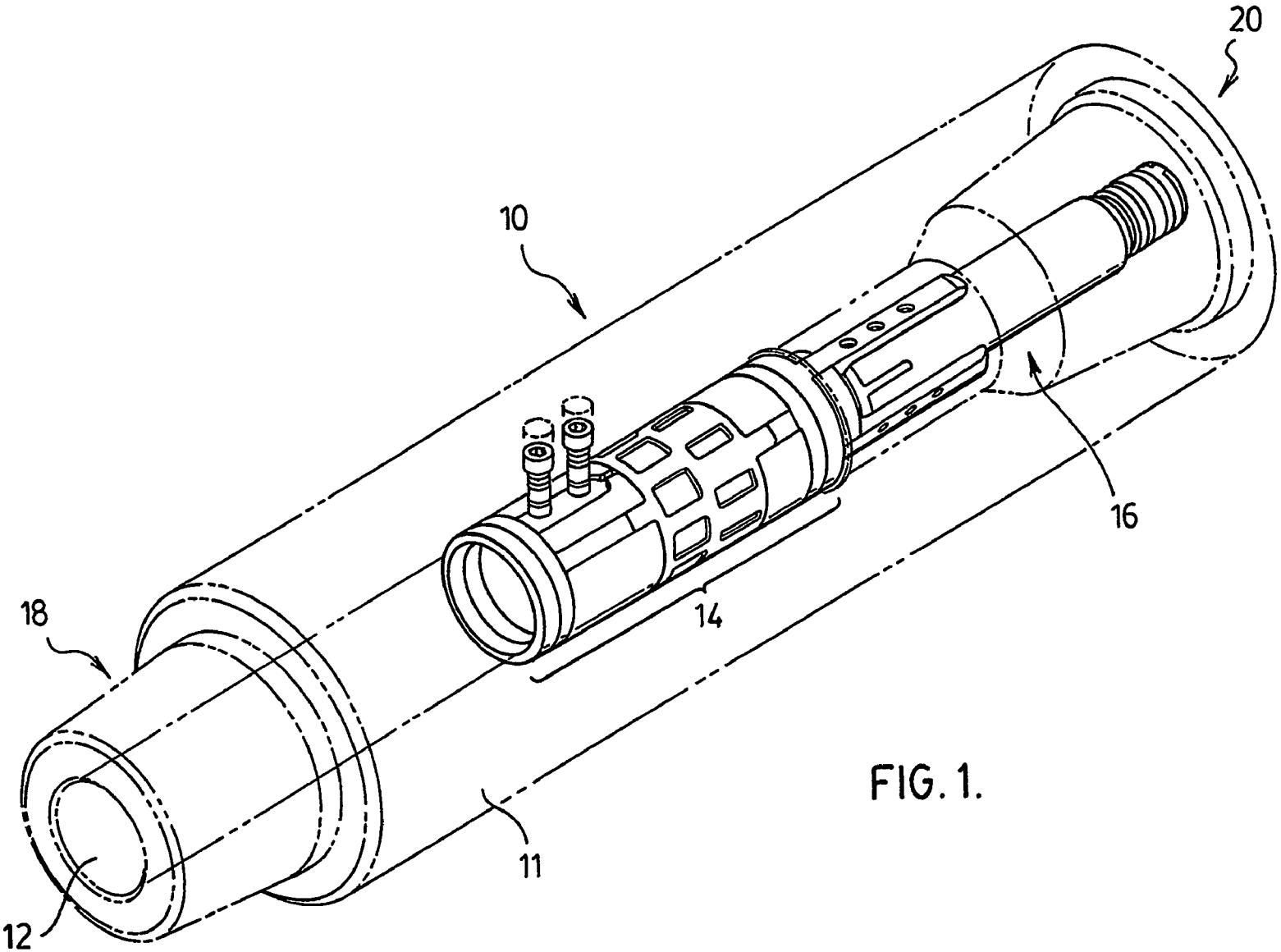
FIG. 1 is a perspective view of an embodiment of the mud pulse landing assembly.

The mud pulse landing assembly of the present invention is used in drill strings, particularly directional oil well drilling strings. The mud pulse landing assembly generally comprises a landing sub body, a retainer and a removable mud pulse generator. FIG. 1 shows an embodiment of a mud pulse landing assembly (10). Mud pulse landing assembly (10) comprises a landing sub body (11), a longitudinal bore (12), a retainer (14) and a removable mud pulse generator (16). The invention provides a mud pulse landing assembly (10) that is capable of remote release of the removable mud pulse generator, providing clear unobstructed passage of any device that may be required to pass through the drill string. The removable mud pulse generator can be displaced in either the forward or reverse direction relative to the mud pulse landing assembly. The assembly (10) further comprises two ends, a first end (18) being adapted to connect to a first drill string component, and a second end (20) being adapted to connect to a second drill string component. The mud pulse landing assembly (10) is circular in cross-section.

Figure 2:
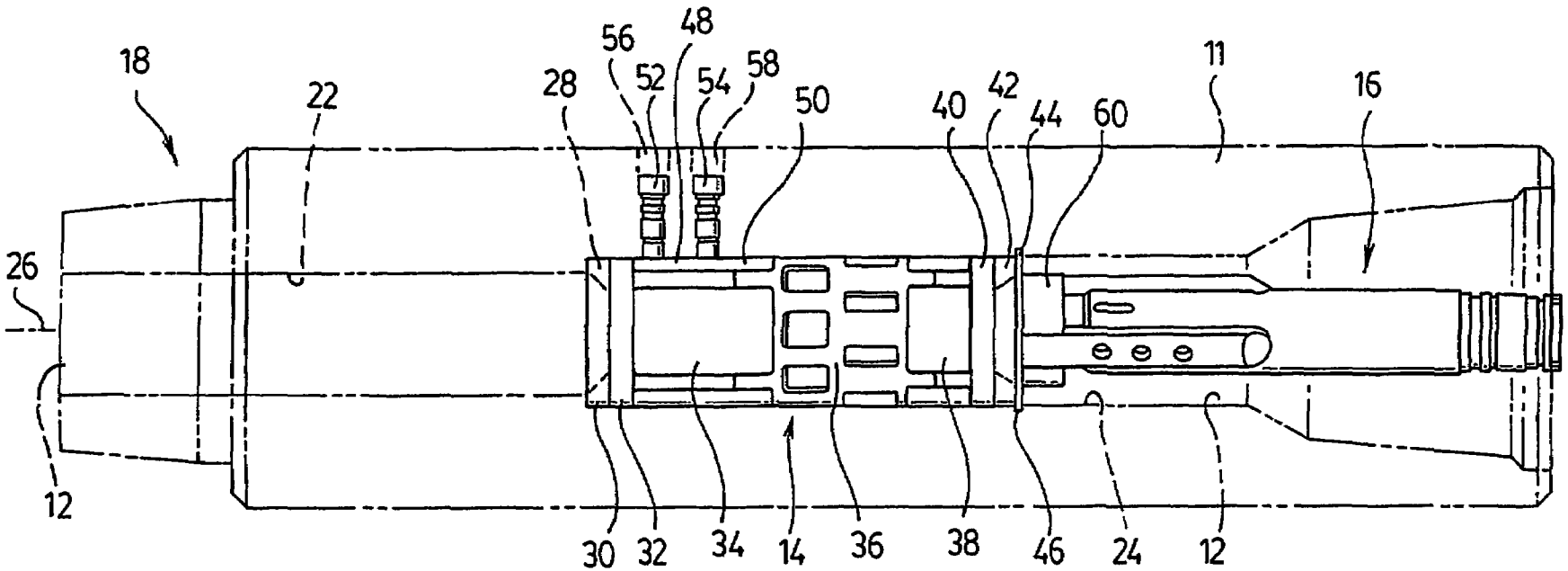
FIG. 2 is a side elevation of the embodiment shown in FIG. 1.

Shown in FIG. 2 is a partial sectional view of the mud pulse landing assembly (10). The longitudinal bore (12) consists of a first region (22) and a second region (24), each being immediately adjacent to each other and concentric with reference to the longitudinal axis (26) of the assembly. The first region (22), with reference to the second region (24) is of a smaller diameter, thereby defining shoulder (28). The first region (22) of the longitudinal bore (12) remains clear and unobstructed in the assembled mud pulse landing assembly (10). In the second region (24), immediately adjacent to the shoulder (28) is a compact flow diverter (30) positioned so that the inside tapered diameter (shown in dot) of the compact flow diverter (30) tapers inwards in a direction facing the second end (20). Immediately adjacent the compact flow diverter (30) moving in a direction towards the second end (20) is bumper ring (32), and retainer (14), the retainer comprising an anti-rotation latch receiver (34), a latch spacer (36) and a thru-bore latch receiver (38). Continuing towards the second end (20), there is a second bumper ring (40) and a second compact flow diverter (42), positioned so that the inside tapered diameter (shown in dot) tapers outwards towards the second end (20). To retain the above elements in place within the second region (24) of the longitudinal bore (12), a retaining ring (44) is positioned immediately adjacent the second compact flow diverter (42), the retaining ring (44) being positioned within a circumferential box-shaped groove (46) located on the inside surface of the mud pulse landing subassembly (11). To is maintain the anti-rotation latch receiver (34) in radial alignment, a key slider (48) is positioned within a recess (50) in the anti-rotation latch receiver (34), the key slider (48) being fixed in place by a first bolt (52) and a second bolt (54) that threadably engages the key slider (48). The first and second bolts (52, 54) are accessible from the exterior of the mud pulse landing assembly (10) by means of a first hole (56), through which the first bolt (52) passes, and a second hole (58), through the second bolt (54) passes. By means of first and second bolts (52, 54) and key slider (48), the anti-rotation latch receiver is maintained in radial alignment, thus preventing rotational movement of the mud pulse generator that is ultimately retained by the retainer. The recess (50) of the anti-rotation latch receiver (34) is longer than the key slider (48) to accommodate vibrational movement in a direction parallel to the longitudinal axis (26). Although the ability to accommodate certain vibrational movement and stress is configured into the means by which the key slider (48) and anti-rotation latch receiver (34) engage, the first and second bumper rings (32, 40) further serve to reduce the various stresses that are commonly associated with directional drilling applications.

Figure 3:
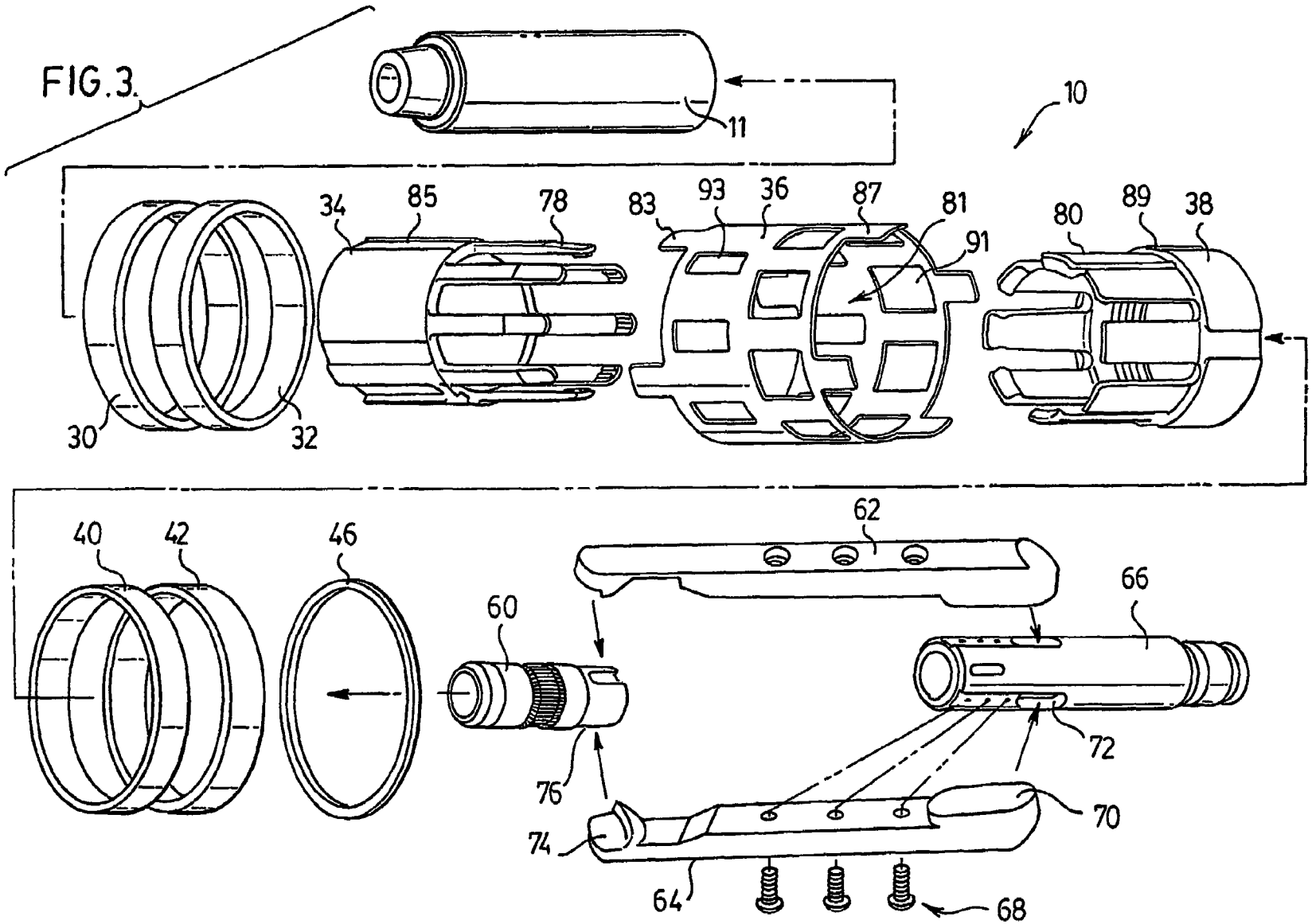
FIG. 3 is an exploded perspective view of the embodiment shown in FIG. 1.

Shown in FIG. 3 is an exploded view of the retainer (14) and removable mud pulse generator (16). As was explained above, the retainer comprises the anti-rotation latch receiver (34), the latch spacer (36), and the thru-bore latch receiver (38). The removable mud pulse generator, is of modular design and comprises a compact muleshoe body (60), first, second and third muleshoe legs (62, 64; third leg not shown) and an MWD tool (66) in a spaced-apart relationship from said compact muleshoe. The muleshoe legs are attached to the MWD tool (66) by bolts or screws (68) or alternate suitable means. Each muleshoe leg, on the end mating with the MWD tool (66), has an elevated step (70) that is received by a corresponding receptacle (72) on the MWD tool (66). Similarly, with respect to each muleshoe leg, on the end mating with the compact muleshoe body (60), each muleshoe leg has an angled step (74) that corresponds to a receiving receptacle (76) on the compact muleshoe body (60). The interaction of the steps on each muleshoe leg with the corresponding receptacles on the receiving structures ensures there is no movement of the compact muleshoe body (60) with reference to the MWD tool (66). It can be appreciated that while the present embodiment uses three legs to attach the MWD tool (66) to the compact muleshoe (60), one skilled in the art may choose to either increase or decrease the number of legs used, as required. In addition, while the present embodiment shows legs that are separate structures that are ultimately attached to the compact muleshoe (60), one skilled in the art may choose to use a compact muleshoe of unitary structure where the legs are integral with the muleshoe body. The modular design of the mud pulse generator and the compactness of the compact muleshoe body (containing the orifice) offers particular advantages to the present invention. By bridging the space between the muleshoe and the MWD tool using legs, instead of a solid enclosure surrounding the MWD tool, and by positioning the MWD tool upstream of the compact muleshoe, destructive forces due to flow turbulence upon the MWD tool is reduced. With this configuration, the mud flowing downwards through the drill string does not enter the muleshoe until after passing the MWD tool, thus restricting the turbulence to the region of the compact muleshoe and the region downstream. Damage resulting from this turbulence can be fixed by merely replacing the compact muleshoe without having to replace the MWD tool.

Figure 4A:
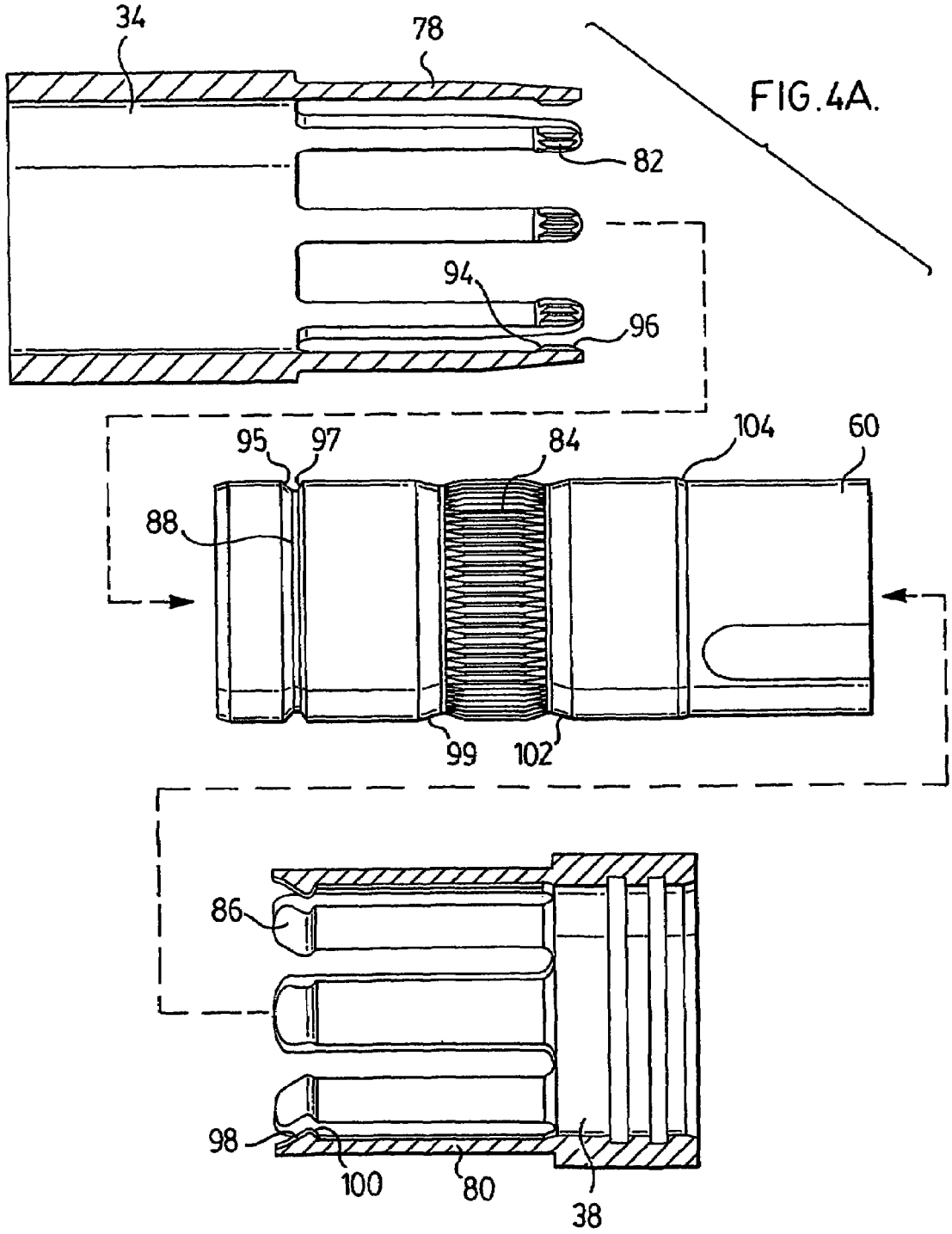
FIG. 4A is an exploded view of the compact muleshoe (shown in side elevation view) and the anti-rotation latch receiver and thru-bore latch receiver (shown in sectional view) of the embodiment shown in FIG. 1.

In an assembled mud pulse landing assembly (10), the removable mud pulse generator (16) is maintained in a fixed spatial and rotation position with respect to the retainer by means of a plurality of anti-rotation latch receiver fingers (78) and a plurality of thru bore latch fingers (80), where the anti-rotation latch receiver fingers (78) and the thru-bore latch fingers (80) are adapted to engage the compact muleshoe body (60). In the assembled position, the anti-rotation latch receiver fingers (78) and the thru bore latch fingers (80) interdigitate within the region (81) defined by the latch spacer (36). Located on one end of the latch spacer (36) are a first set of tongue extensions (83) that fit within corresponding channels (85) on the anti-rotation latch receiver (34). Similarly, on the other end of the latch spacer (36) are a second set of tongue extensions (87) that fit within corresponding channels (89) on the thru-bore latch receiver (38). In the assembled position, the anti-rotation latch receiver (34) and the thru-bore latch receiver (38) remain spatially fixed due to the engagement between the tongue extensions (83, 87) of the latch spacer (36) and the corresponding channels (85, 89) on the anti-rotation latch receiver (34) and the thru-bore latch receiver (38). Since the anti-rotation latch receiver (34) is maintained in a fixed position by means of the key slider (48) and first and second bolts (52, 54; see FIG. 2), it follows that by means of the latch spacer (36), the thru-bore latch receiver (38) is also maintained in a fixed position. With respect to the fingers engaging the compact muleshoe body (60), as shown in FIG. 4A, the anti-rotation latch receiver fingers (78) have located on the inside surface of the terminal ends a plurality of elongated longitudinally-oriented engagement splines (82) that engage the compact muleshoe body (60) at receiving elongated radial splines (84) located on the outside surface of the compact muleshoe body (60), as shown in FIG. 4B. This serves to prevent rotational movement of the compact muleshoe body relative to the landing sub body. Similarly, the thru-bore latch fingers (80) have located on the inside surface of the terminal ends a detent or ridge (86) that engages a receiving groove (88) located on the outside surface of the compact muleshoe body (60), as shown in FIG. 4C. The ridge or detent serves to engage the compact muleshoe to maintain it in fixed spatial relationship relative to the landing sub body. The need to maintain the various elements in a fixed position resides in the fact that in some applications, the internal electronics of the MWD tool require positioning at precise, accurate, known angles. By maintaining a fixed internal arrangement, the required angle of the MWD tool can be accurately set. Furthermore, to allow for accurate guidance of the drill, the MWD tool must be fixed with respect to the bend in the drill motor.

Figure 5A:
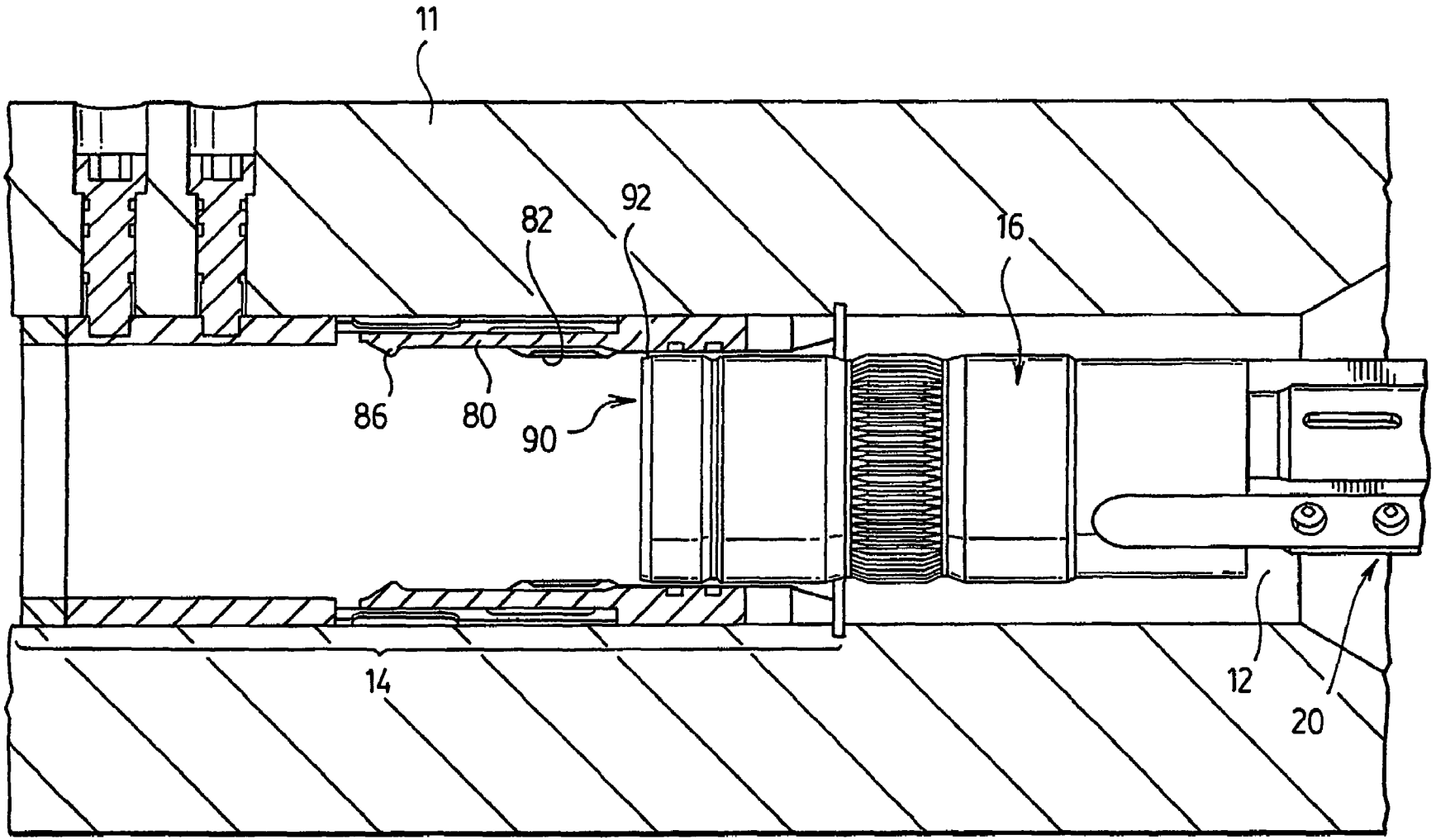
FIGS. 5A, 5B and 5C are sectional views showing the insertion of the removable mud pulse generator into the retainer of the mud pulse landing assembly.
Figure 5B:
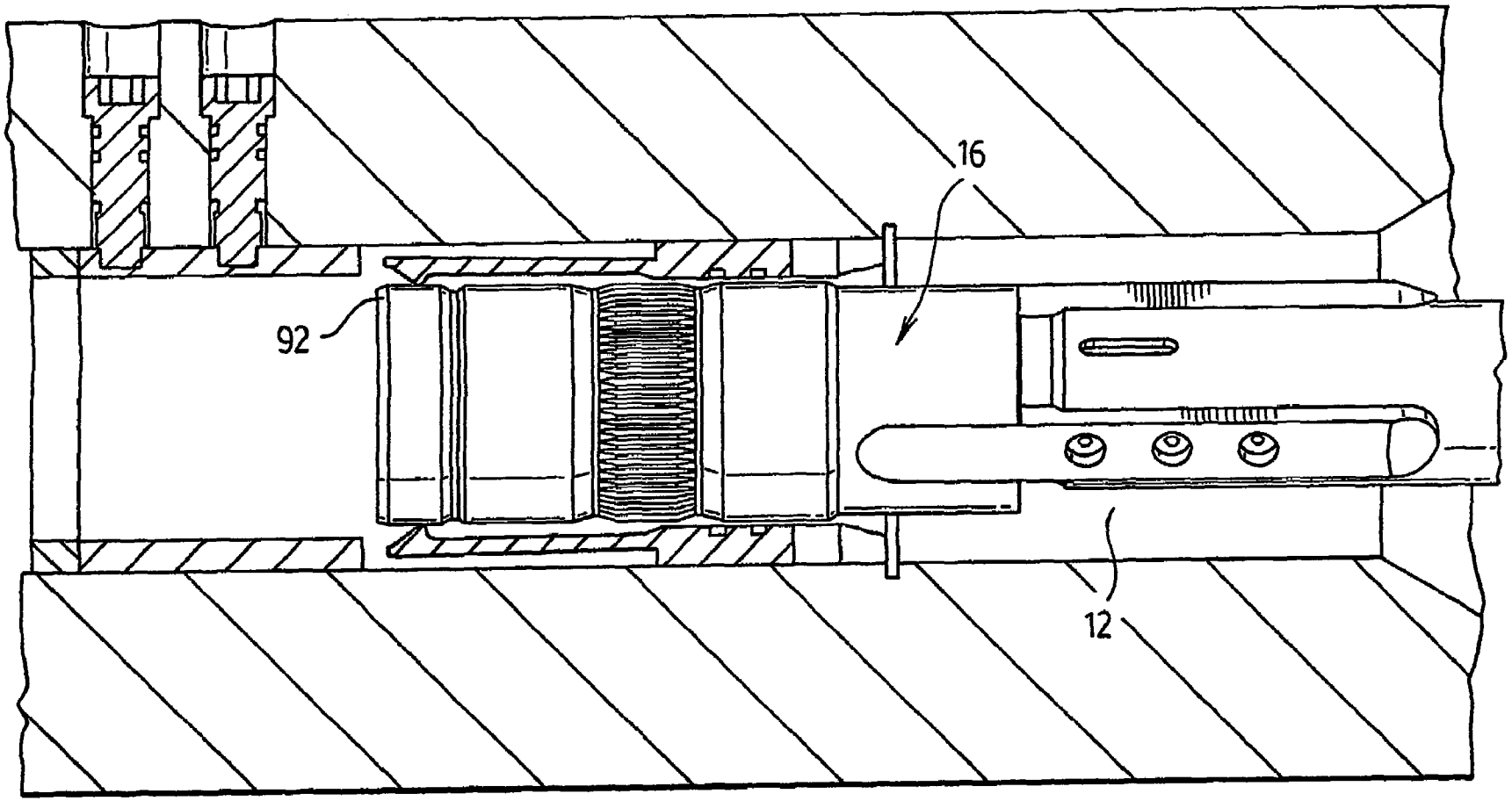
Figure 5C:
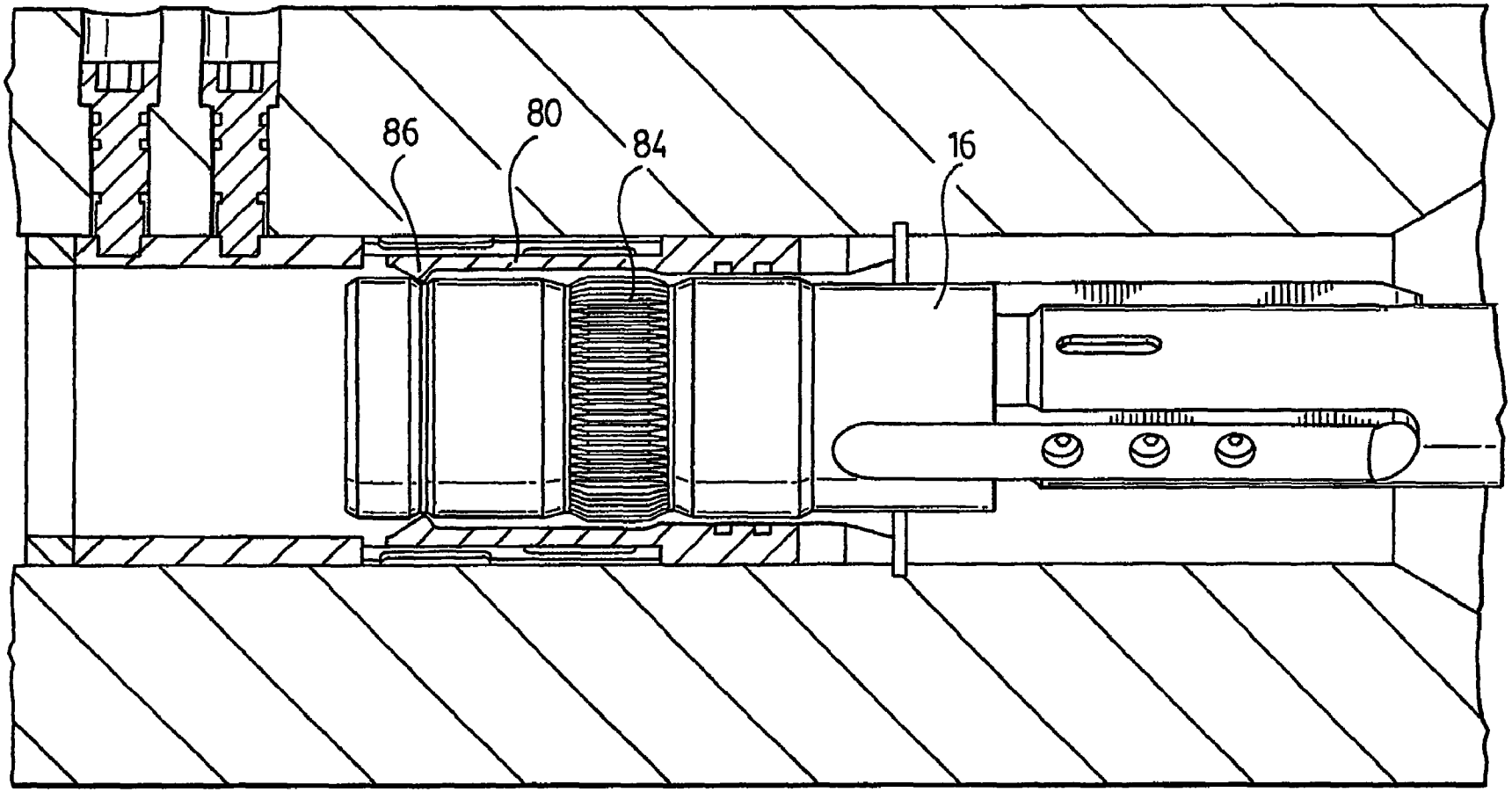

The releasable self-seating connecting means of the mud pulse landing assembly (10) will be explained by making reference to FIGS. 5A, 5B and 5C. With the retainer (14) in position within the mud pulse landing sub (11), the removable mud pulse generator (16) can be inserted into place. Shown in FIG. 5A is the insertion of the mud pulse generator (16) into the mud pulse landing sub (11) from the second end (20). To facilitate insertion of the mud pulse generator (16) into the mud pulse landing sub (11), the leading end (90) of the mud pulse generator (16) has been configured with a tapered edge (92). As the mud pulse generator (16) is moved through the longitudinal bore (12), the tapered edge (92) of the mud pulse generator encounters the elongated engagement splines (82) of the anti-rotation latch receiver fingers (78). To accommodate movement of the mud pulse generator (16) beyond the elongated engagement splines (82) of the anti-rotation latch receiver fingers (78) in a direction towards the first end (18; see FIG. 2), the anti-rotation latch receiver fingers (78) have been adapted to flex outwardly thus permitting movement of the mud pulse generator (16) through the longitudinal bore (12). To accommodate this outward flex of the anti-rotation latch receiver fingers (78), the latch spacer (36) has a series of openings (91; see FIG. 3) in positions corresponding to the terminal ends of each anti-rotation latch receiver finger (78). To further facilitate passage of the mud pulse generator (16) beyond the anti-rotation latch receiver fingers (78), the elongated longitudinally-oriented engagement splines (82) are configured with a first angled side (94) and a second angled side (96; refer to FIG. 4 to see angled sides) to allow for outward deflection of anti-rotation receiver fingers (78). As the mud pulse generator (16) is moved further through the longitudinal bore (12) towards the first end (18; see FIG. 2), the tapered edge (92) of the mud pulse generator (16) encounters the ridge (86) on the inside surface of the terminal ends of the thru-bore latch fingers (80). To allow for passage of the mud pulse generator (16) beyond the ridge (86), the thru-hold latch fingers (80) are adapted to flex outwardly. To accommodate this outward flex of the thru-bore latch receiver fingers (80), the latch spacer (36) has a series of openings (93; see FIG. 3) in positions corresponding to the terminal ends of each thru-bore latch receiver finger (80). To further facilitate movement of the mud pulse generator (16) beyond the ridge (86), the ridge is tapered at a first side (98) and a second side (100; refer to FIG. 4 to see angled sides) to allow for outward deflection of the thru-bore latch receiver fingers (80), as shown in FIG. 5B. As the mud pulse generator (16) is positioned into operational position, as shown in FIG. 5C, the elongated splines (82) of the anti-rotation latch receiver fingers (78) engage the elongated radial splines (84) of the compact muleshoe body (60), thus preventing rotation about the longitudinal axis (refer to FIG. 4B). Concurrently, the ridge (86) on the thru-bore latch receiver fingers (80) position within the receiving groove (88) thereby locking the mud pulse generator (16) in place within the retainer (14) (See FIG. 4C).

Figure 8:
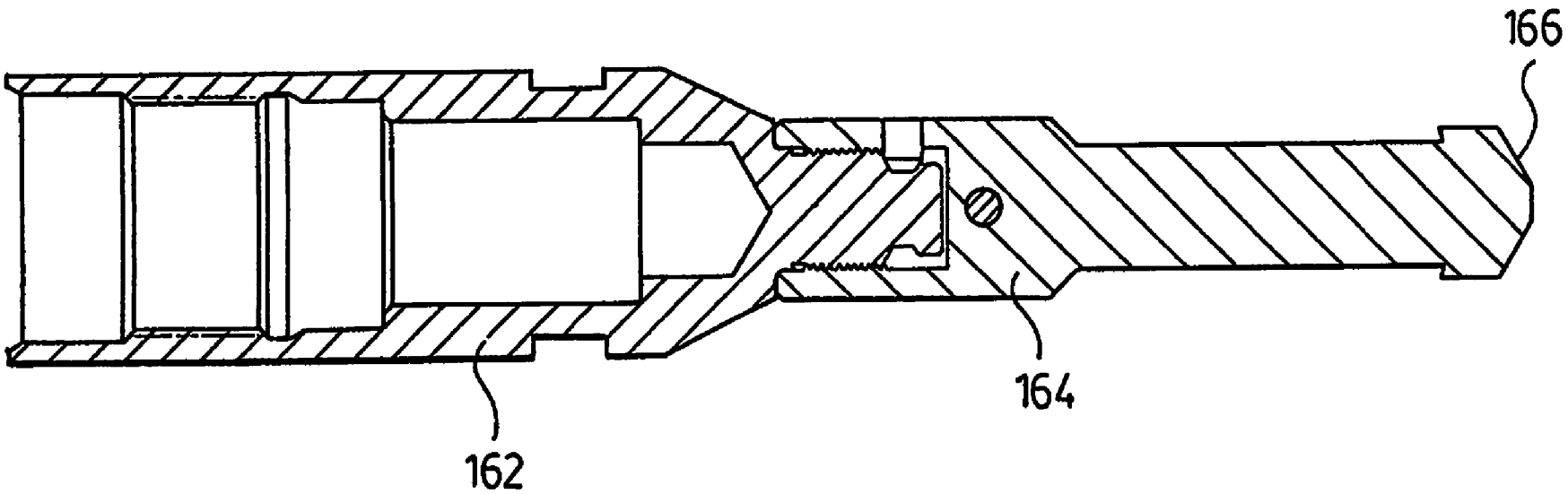
FIG. 8 is a section view of a spear point assembly and retriever tool for wireline retrieval of the tool string.

The insertion or removal of the removable mud pulse generator can be performed or operated remotely. For example, pressure can be applied to the tool string to push and disengage the removable mud pulse generator from the retainer in the downward direction. Alternately, a wireline can be lowered into the string to engage the removable mud pulse generator, such that a pulling force on the wireline disengages the removable mud pulse generator in the upward direction. For example, the tool string can be fitted with a spear point assembly comprising a spear point housing (162) and spear point (164) to which a "J-Latch" or "overshot" device can be attached at end (166), allowing the tool string to be retrieved to the surface (See FIG. 8). The retainer and removable mud pulse generator allow for the initiating activity to be remote relative to the location of the mud pulse landing assembly. Movement of the mud pulse generator in either direction is facilitated and self aligned by incorporating into the construction various tapers to eliminate the abutment of opposing shoulders. As previously mentioned, the elongated splines (82) of the anti-rotation latch receiver fingers (78) are dual tapered as are the ridges (86) of the thru-bore latch receiver fingers (80). To further facilitate movement in either direction, the compact muleshoe body (60) also incorporates various tapers. As shown in FIG. 4A, the receiving groove (88) of the compact muleshoe body (60) has a first outwardly tapering edge (95) and a second outwardly tapering edge (97). Similarly, in the region of the elongated radial splines (84) of the compact muleshoe body (60), there is a first outwardly tapering edge (99) and a second outwardly tapering edge (102). An additional taper (104) is incorporated into the design of the compact muleshoe body (60) to further facilitate movement, especially when directing the mud pulse generator upwards through the drill string.

Figure 6A:
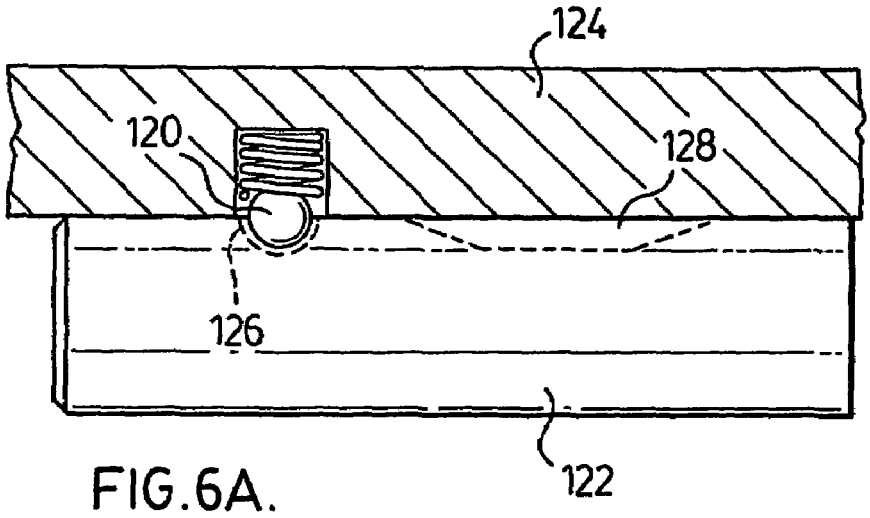
FIG. 6A is a side view of an alternate embodiment showing a ball detent retainer.
Figure 6B:
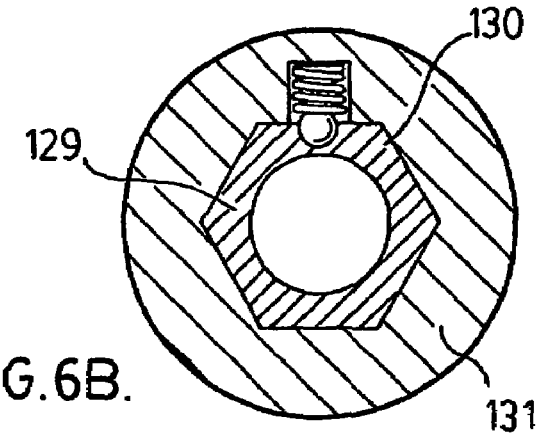
FIG. 6B is a cross-sectional view of an alternate embodiment showing non-circular keyed mating surfaces of the mud pulse generator and landing sub body to prevent rotational movement.
Figure 6C:
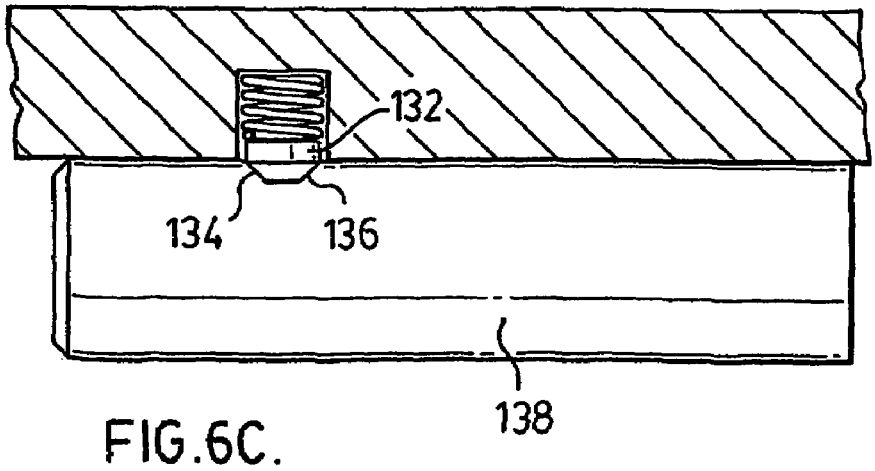
FIGS. 6C (side view) and 6D (cross-section view) show another alternate embodiment having a detent system designed to maintain both spatial and rotational position.
Figure 6D:
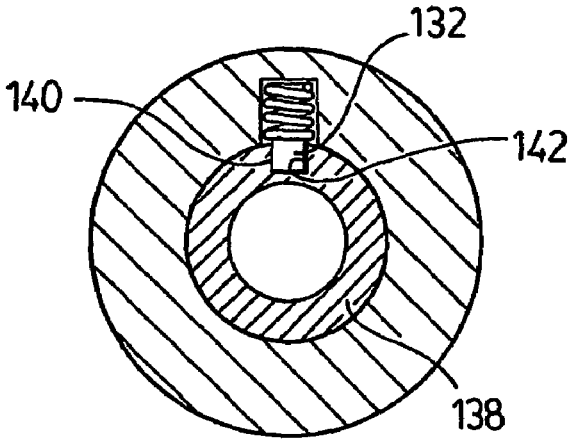
FIG. 6E is a cross-sectional view showing another embodiment having a detent system configured with a spline.
FIG. 6F is a side view of another embodiment showing a detent actuator and receiver system for retaining the mud pulse generator in the landing sub body.
Figure 6E:
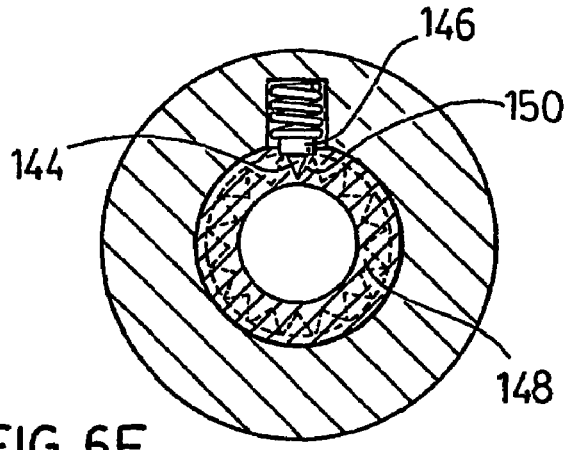
Figure 6F:
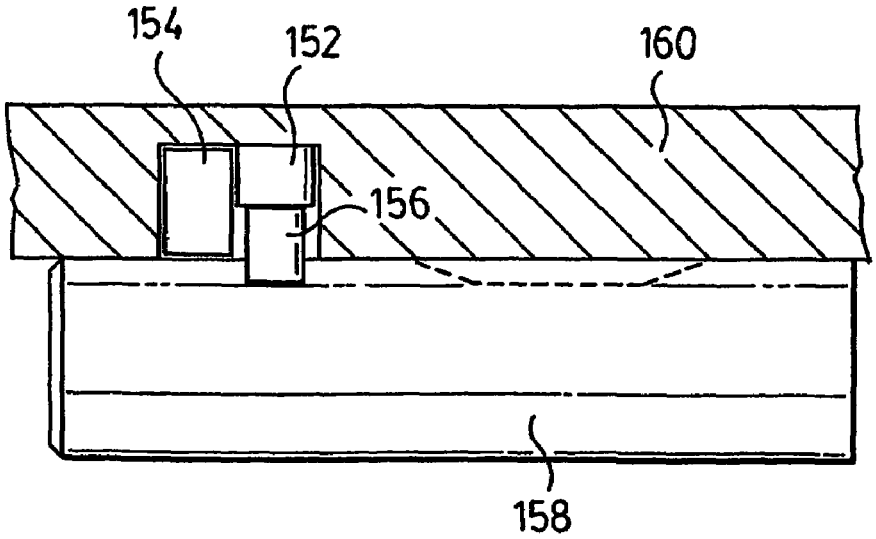

FIG. 6A shows an alternate embodiment of a mud pulse landing assembly, where the retainer (120) comprises a detent for retaining the removable mud pulse generator (122) in place within the landing sub body (124). The removable mud pulse generator is correspondingly adapted with a receptacle (126) to receive the detent. An example of a detent that can be used is a spring-actuated ball detent (as shown in FIG. 6A). To prevent rotation of the mud pulse generator, the retainer further comprises a coupler for registering the mud pulse generator in a fixed rotational position relative to the landing sub body. The coupler may comprise at least one spline (128) for registering the mud pulse generator in a fixed rotational position relative to the landing sub body. The splines for registering the mud pulse generator in place are machined on at least a portion of adjacent surfaces of the removable mud pulse generator (122) and the landing sub body (124). Alternatively, removable mud pulse generator (129) may be registered in a fixed rotational position relative to the landing sub body (131) by means of a coupler comprising non-circular keyed mating surfaces (130; i.e. a hex fit) as shown in FIG. 6B. Alternatively, the detent may be configured with a means for locking the mud pulse generator in fixed rotational position. For example, as shown in FIGS. 6C and 6D, the detent (132) could be configured with a tapered front edge (134) and a tapered rear edge (136), to facilitate engagement and disengagement from the mud pulse generator (138), but with non-tapered side walls (140) that engage side walls (142) configured into the detent receptacle on the mud pulse generator (138). Additionally, as shown in FIG. 6E, the means for locking could comprise at least one longitudinal spline (144) on the detent (146), the removable mud pulse generator (148) being adapted to receive both the detent, as well as registering the splined detent in a corresponding splined receptacle (150). Another alternative, as shown in FIG. 6F is a retainer comprising a retainer actuator (152) and a receiver (154), where the retainer is remotely activated by means of a actuating signal. The receiver (154), on receiving and actuating signal acts to actuate the retainer actuator (152), disengaging the detent (156), thereby releasing the removable mud pulse generator (158) from the landing sub body (160). While the embodiment shown in FIG. 6F has an additional spline to maintain the mud pulse generator (158) in fixed rotational position relative to the landing sub body (160), an alternate means as discussed above may also be implemented.

The retainer of the present invention presents certain advantages over the prior designs. The retainer of the present invention is positioned between the mud pulse generator and the landing sub body at a location that is either at or upstream of the outlet end of the compact muleshoe. By placing the retainer between the mud pulse generator and the landing sub body, the retainer is separated from the mud flow which can be highly abrasive and destructive. The retainer is effectively shielded or protected from the mud flow, thus improving overall reliability. In addition, by placing the retainer in this protected position, the area downstream of the compact muleshoe remains unobstructed as a seat or stop for receiving a forward shoulder of the muleshoe is not necessary. A stop or seat in the area downstream of the muleshoe would be subjected to extreme flow turbulence and abrasiveness, ultimately leading to problems in reliability. The present invention overcomes these problems by protecting the retainer from the turbulent and abrasive mud flow.

The use of a retainer to maintain the mud pulse generator in fixed spatial and rotational relationship with the landing sub body ensures proper positioning of the MWD components. In addition, it serves to prevent the mud pulse generator from displacing upwards in the event of sudden backflow. Furthermore, vibrational forces are experienced during drilling and the retainer system of the present invention serves to maintain the mud pulse generator in position under extreme conditions. The retainer or detent serves to engage the mud pulse generator, where prior designs merely provide a seat.

The retainer may also be used as a universal mount to retain alternate tools or instrumentation for use in analyzing the borehole geology. For example, a tool could be lowered into the drill string, engaged by the retainer, and subsequently released in either a downward or upward direction depending on the analytical operation to be performed. It may be possible to set up a series of tools in tandem, where the retainer is used to releasably retain the tandem assembly in a series of positions corresponding to the series of tools in the tandem string.

Figure 7A:
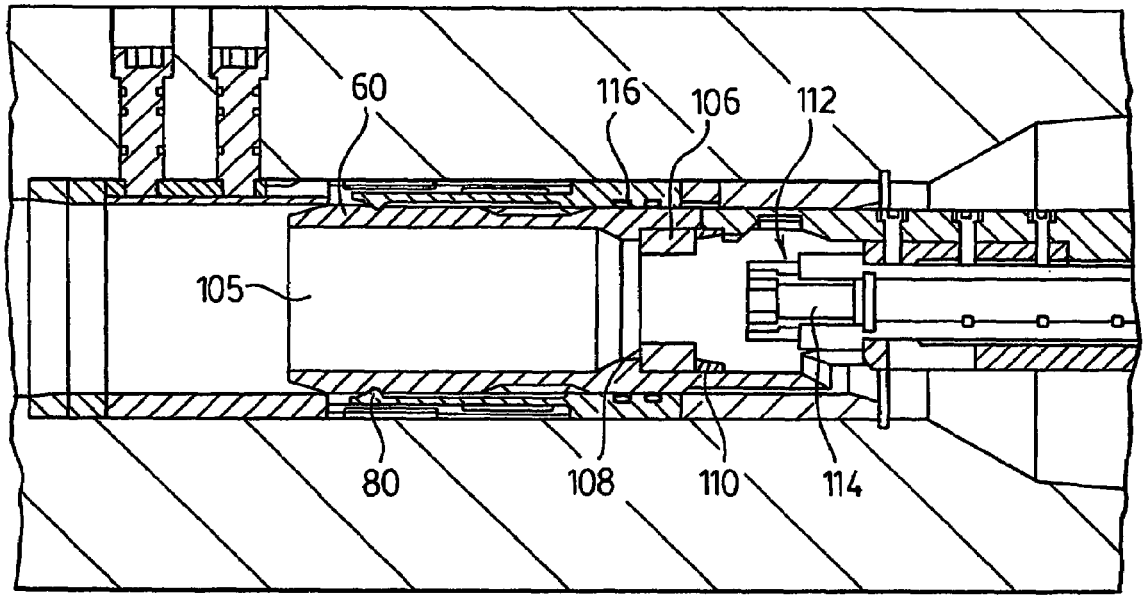
FIG. 7A is a sectional view of the retainer with the removable mud pulse generator in operational position and the piston in a retracted position.
Figure 7B:
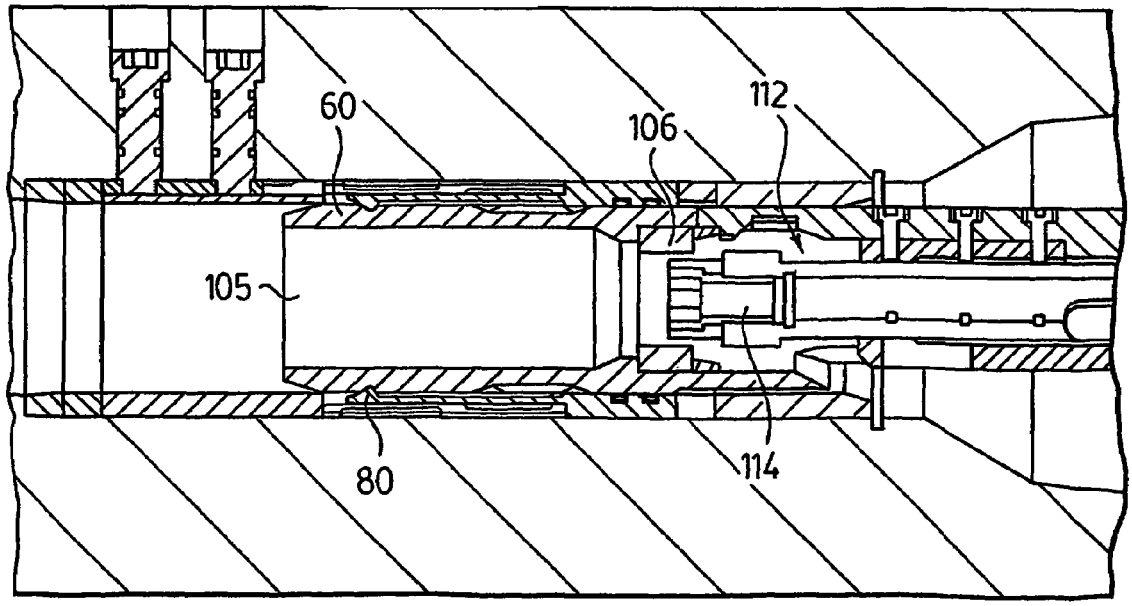
FIG. 7B is a sectional view of the retainer with removable mud pulse generator in position, where the piston is in close proximity to the orifice.

In order for the mud pulse landing assembly to generate communicative mud pulses that can be measured at the surface (i.e. mud pulse telemetry), a system well known in the art for producing such pulses must be present which includes an orifice and a reciprocating piston. In traditional mud pulse telemetry, the orifice is a fixed element in the construction. In an effort to allow for passage of various devices through the drill string without obstruction by the orifice, the present invention allows for removal of the orifice due to its incorporation into the removable mud pulse generator. As shown in FIG. 7A, the compact muleshoe body (60) has a longitudinal bore (105) that contains a mud pulse orifice (106) that has one face positioned against a formed shoulder (108) on the inside surface of the compact muleshoe body (60). The mud pulse orifice (106) is retained in position by a suitable means, shown in the figure as a retaining ring (110). To produce a mud pulse, a piston actuator (112), housed within the MWD tool is activated, bringing into close proximity to the mud pulse orifice (106) a piston (114) that results in higher mud pressure (See FIG. 7B). The activation of the piston is controlled by various means well known in the art.

Although preferred embodiments of the invention have been described herein in detail, it will be understood by those skilled in the art that variations may be made thereto without departing from the spirit of the invention, as described herein.

The invention claimed is:

1. A mud pulse assembly for producing mud pulses for communicating during directional drilling data telemetry, comprising:

a removable mud pulse generator for positioning a landing sub body, said removable mud pulse generator having a outlet end, and a retainer for releasably engaging said removable mud pulse generator in said landing sub body, said retainer engaging said mud pulse generator at or upstream of said outlet end, said retainer being remotely operable to release said removable mud pulse generator from said mud pulse assembly, wherein said retainer comprises at least one detent for retention of said removable mud pulse generator, and a coupler for preventing rotation of said removable mud pulse generator relative to said landing sub body, said removable mud pulse generator being adapted to receive said detent and engage said coupler, wherein said at least one detent is a spring-actuated ball detent, biased towards said removable mud pulse generator.

2. A mud pulse assembly for producing mud pulses for communicating during directional drilling data telemetry, comprising:

a removable mud pulse generator for positioning in a landing sub body, said removable mud pulse generator having a outlet end, and a retainer for releasably engaging said removable mud pulse generator in said landing sub body, said retainer engaging said mud pulse generator at or upstream of said outlet end, said retainer being remotely operable to release said removable mud pulse generator from said mud pulse assembly, wherein said retainer comprises an anti-rotation latch receiver, a latch spacer and a thru-bore latch receiver, said anti-rotation latch receiver and said thru-bore latch receiver each having extended from one end a plurality of fingers, said plurality of fingers of each of said anti-rotation latch receiver and said thru-bore latch receiver interdigitating within said latch spacer, said anti-rotation latch receiver being retained in fixed position by means of bolts passing through said landing sub body and threadably engaging a key slider positioned within a recess of said anti-rotation latch receiver, said latch spacer being adapted to maintain said anti-rotation latch receiver in fixed spatial relationship relative to said thru-bore latch receiver.

3. The mud pulse landing assembly of claim 2, wherein each of said plurality of fingers of said anti-rotation latch receiver comprises a plurality of elongated longitudinal splines for mating with corresponding receiving elongated radial splines on said removable mud pulse generator, preventing rotation of said removable mud pulse generator relative to said mud pulse landing assembly.

4. The mud pulse landing assembly of claim 2, wherein each of said plurality of fingers of said thru-bore latch receiver comprises at least one detent for mating with said removable mud pulse generator, ensuring retention of said removable mud pulse generator in said mud pulse landing assembly, said removable mud pulse generator being adapted to receive said detent.

5. A mud pulse assembly for producing mud pulses for communicating during directional drilling data telemetry, comprising:

a removable mud pulse generator for positioning in a landing sub body, said removable mud pulse generator having a outlet end, and a retainer for releasably engaging said removable mud pulse generator in said landing sub body, said retainer engaging said mud pulse generator at or upstream of said outlet end, said retainer being remotely operable to release said removable mud pulse generator from said mud pulse assembly, wherein said retainer further comprises a retainer actuator and receiver for receiving an actuating signal, said receiver on receiving said actuating signal acts to actuate said retainer actuator, releasing said removable mud pulse generator from said landing sub body.

* * * * *